United States Patent [19]

Maccaferri

[11] Patent Number: 4,809,579

[45] Date of Patent: Mar. 7, 1989

[54] PLASTIC VIOLIN

[76] Inventor: Mario Maccaferri, 24 Redfield St., Rye, N.Y. 10580

[21] Appl. No.: 194,298

[22] Filed: May 16, 1988

[51] Int. Cl.[4] ..... G10C 3/18

[52] U.S. Cl. ..... 84/293

[58] Field of Search ..... 84/274, 275, 293

[56] References Cited

U.S. PATENT DOCUMENTS

| | | | |
|---|---|---|---|
| 895,274 | 8/1908 | Nusekabel | 84/274 |
| 1,887,398 | 11/1932 | Chase | 84/293 |
| 1,912,106 | 5/1933 | Turturro | 84/293 |
| 3,427,915 | 2/1969 | Mooney | 84/275 |
| 3,618,442 | 11/1971 | Kawakami | 84/193 X |
| 3,699,836 | 10/1972 | Glasser | 84/275 X |
| 3,964,362 | 6/1976 | Quemore, Sr. | 84/275 X |

*Primary Examiner*—L. T. Hix
*Assistant Examiner*—Brian W. Brown

[57] ABSTRACT

A plastic violin is provided with means for compensating for change of tension in the violin strings due to dimensional instability of the plastic caused by variations in temperature or pressure. The plastic violin comprises an elongated bar below the finger board and is bonded thereto. An elongated stabilizing bar is placed in the hollow portion of the violin body and has a proximal end which abuts an upright portion or identation in the reinforcing bar and a distal end which is received by a threaded compensating screw which is manipuable to bias the proximal end of the stabilizing bar against the surface of the indented upright portion of the reinforcing bar.

6 Claims, 2 Drawing Sheets

PLASTIC VIOLIN

FIELD OF THE INVENTION

This invention relates generally to stringed musical instruments and particularly to violins. More specifically, this invention is concerned with plastic violins and to providing such plastic violins with acoustic properties and tones which match those of high-grade wood violins.

BACKGROUND OF THE INVENTION

The classical construction of the violin is over one hundred years old. As stated in U.S. Pat. No. 3,964,362, the shape of the violin and the beauty of its tone is the product of fine materials, long hours of painstaking efforts by skilled craftsmen, and extended periods of aging and adjustment, all of which have resulted in a costly instrument. Recognizing that such violins, which are hand made and fabricated from high grade wood are expensive, attention has been directed to making stringed instruments, including violins, from non-wooden materials, such as, for example, plastics, in order that such instruments can be factory-made, inexpensively. For example, U.S. Pat. No. 3,427,915 discloses a violin having front and back plates made from non-wooden materials intended to match the acoustic properties of a high-grade violin. According to said patent, this is accomplished by the application of certain "mathematical rules" for selecting materials having suitable combinations of density, flexural modules, and damping factors.

According to another patent, i.e., U.S. Pat. No. 3,618,442, foamed materials of various synthetic resins have been used for making vibrating plates of sound instruments, such as, piano or guitar. Such resins include polystyrene, polyvinylchloride and the like.

Thus, while it has generally been recognized that plastic violins can be made less expensively than wood violins, it has also been recognized that plastic violins do not exhibit the acoustic quality and tone consistency of wood violins. The disparity in acoustic qualities of these different violins is primarily due to difficulties inherent in the properties of plastic materials. When made of plastic, variations in pressure and ambient temperature can cause the neck portion of the violin to bend forward thus causing variations in the tension of the violin strings and, consequently, variations in the height of the string relative to the finger board. Moreover, when the neck of a plastic violin bends, it remains bent and does not return to its original shape or position. These variations make it very difficult to tune up the strings and practically impossible to play the violin with consistent notes or tunes.

It is an object of this invention to provide a plastic string instrument, particularly a plastic violin, having the same acoustic properties as high-grade wood violins.

It is a further object of this invention to provide a plastic violin construction which is stabilized against bending of the violin's neck due to variations in ambient temperatures and changes in pressure.

It is another object of this invention to provide a plastic violin construction which has a relatively fixed and constant height from the strings to the finger board regardless of the pressures exerted on the strings and irrespective of the variations in ambient temperatures.

It is also a feature of the present invention to provide plastic violins which can be mass-produced and factory-made inexpensively as compared to hand-made wood violins.

Other objects and features of the present invention will be more readily understood from the ensuing detailed description and the accompanying drawings.

SUMMARY OF THE INVENTION

In accordance with this invention, a plastic violin is provided with means for stabilizing the height between the finger board and the top surface of the violin. This is achieved by placing an elongated reinforcing bar below the finger board and bonding it thereto. The reinforcing bar has a relatively flat portion, an upright portion and a relatively inclined portion which is coterminous with the finger board. An elongated stabilizing bar is disposed in the violin body and has a proximal end which is wedged or pressed against the upright section of the reinforcing bar, and a distal end which is received by a threaded screw disposed at the lower end of the violin. By adjusting the screw, the stabilizing bar can be biased forward so that the proximal end of the stabilizing bar can press against said upright section, and vice versa. In this manner, the change in tension of the springs resulting from change in height of the string relative to the finger board surface can be adjusted to keep the height constant for consistent tone.

BRIEF DESCRIPTION OF THE DRAWINGS

In the drawings, wherein like reference numerals are employed to designate like parts.

DETAILED DESCRIPTION OF THE PRESENT INVENTION

Figure 1:
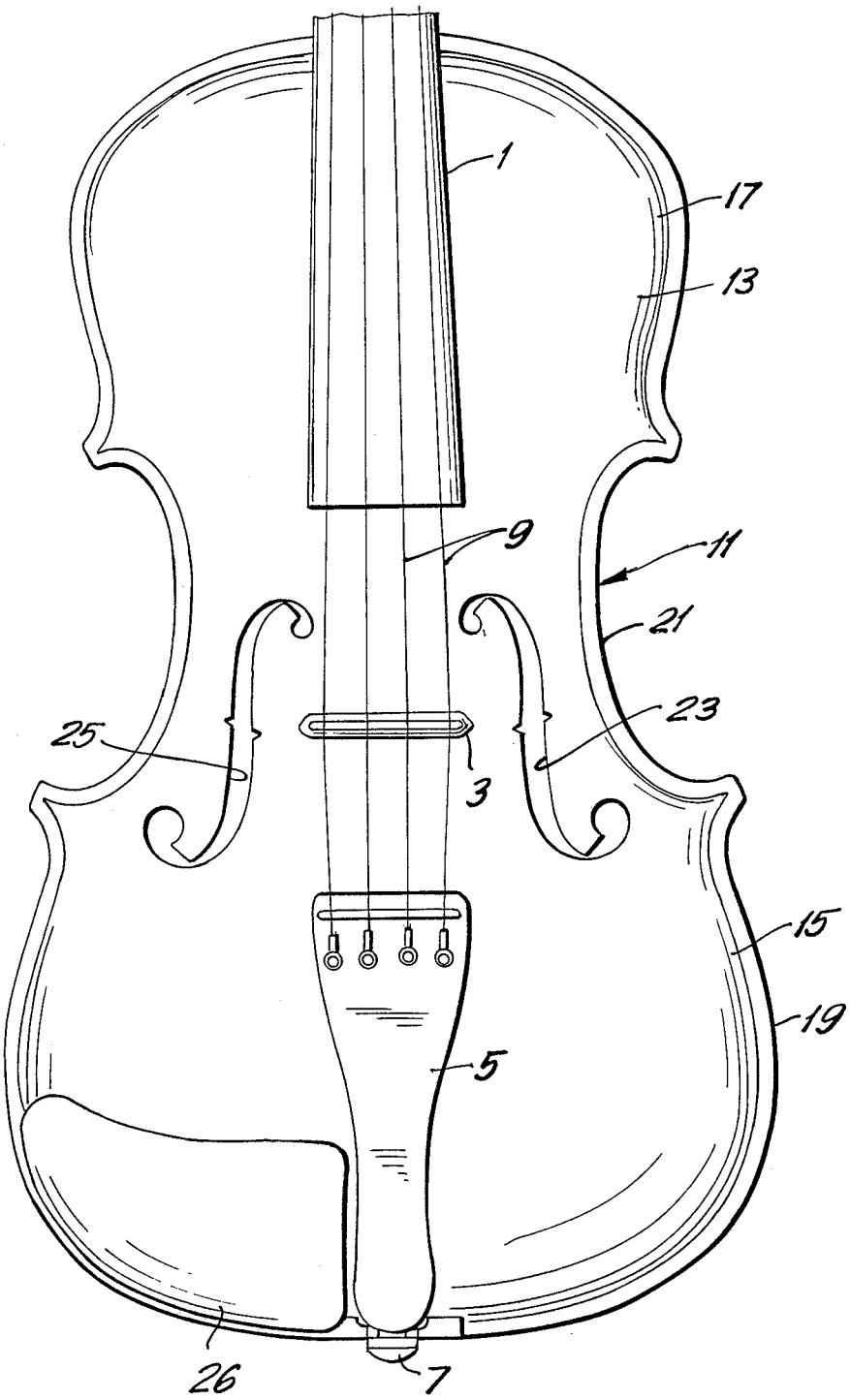
FIG. 1 is a top view of a typical violin with the neck portion not shown.

Referring to the drawings, it will be noted that the general appearance and construction of the plastic violin of the present invention is the same as conventional violins such as, for example, the violin shown in U.S. Pat. No. 3,699;836. Thus, the violin has a finger board 1, a bridge 3, a tail piece 5, a post 7 and strings 9. These parts are attached to and are carried on plastic sound box 11 defined by two panels; a front panel 13 and a rear panel 15, connected to each other by side walls (not shown). The panels 13, 15 which make up the sound box 11 each has an upper bulged portion 17 and a lower bulged portion 19 with a curved portion or bout 21 therebetween. The upper sound portion 15 includes the usual pair of sound holes 23 and 25. The lower bulged portion has a chin rest 26.

Figure 2:
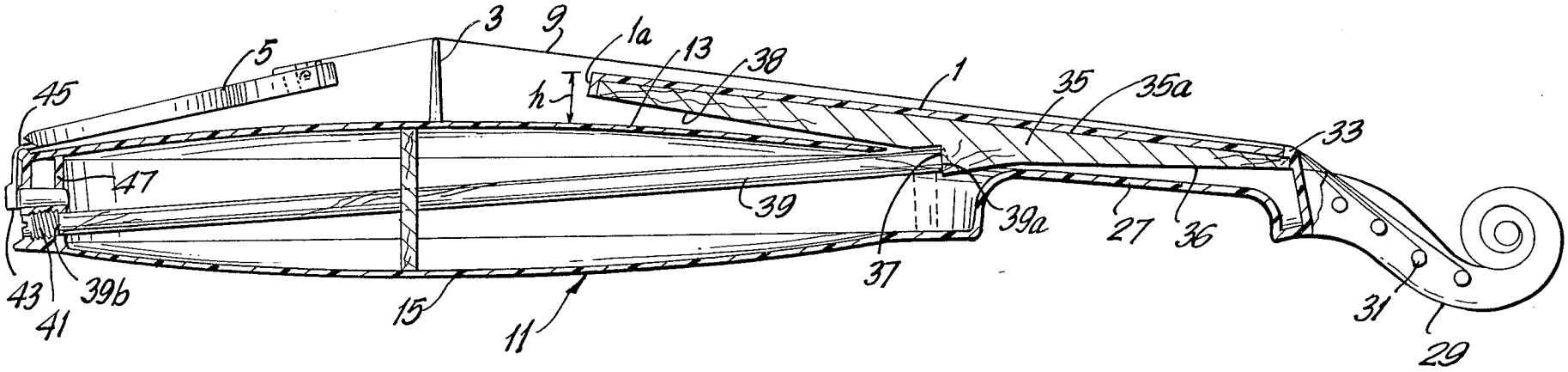
FIG. 2 a side elevational view, partly in section, showing a plastic violin similar to FIG. 1 but incorporating the novel features of the present invention.

Referring now to FIG. 2 the violin has a neck portion 27, the scroll 29, tuning pegs 31 and the knots 33. An elongated reinforcing wooden bar 35 is securely fixed to the finger board 1 which, in the present invention, is made of a plastic material. The reinforcing wooden bar 35 can be either cemented, bonded or otherwise pressure fitted into the finger board 1 and thus serves to reinforce the finger board and prevent it from bending due to variation in pressure and/or temperature of the plastic. The reinforcing wooden bar 35 is substantially coextensive with the finger board 1 along its upper surface 35*a* and is defined at its lower section by a relatively flat portion 36 and upright portion or shoulder 37 and an inclined portion 38 which abuts the bent segment la of the finger board 1 as shown in FIG. 2.

As it was previously explained, one difficulty with plastic violins is that changes in pressure and/or temperature cause the neck portion 27 of the violin to bend thus, causing variations in tensions in the strings 9, due to change in the distance or height "h" between the surface of the finger board 1 and the top surface of the top panel 13 of the violin. These variations make it very difficult to tune up the strings of a plastic violin to play consistent notes. Therefore, and in accordance with the present invention, an elongated wooden stabilizing bar 39 is provided in the hollow section of the violin body, between the front and rear panels 13, 15. The stabilizing bar 39 has a proximal end **39*a* which abuts and is wedged against the shoulder 37 of the reinforcing wooden bar 35, and a distal end 39*b* which is received by an externally threaded compensating screw 41, with the screw 41 being manipulable by threading to thereby increase or decrease the pressure exerted by the proximal end 39*a* of the reinforcing wooden bar 35 against the surface 37. Thus, by adjusting the screw 41, it is possible to compensate for he change in tension of the strings 9 so as to maintain a relatively constant and stable distance "h" between the surface of the finger board 1 and the top surface 13**. This distance ideally is about 21 mm in violins.

As is further shown in FIG. 2, a post 43 serves to securely retain the tail piece 5 by anchoring the tail piece extension 45. The pin 47 serves to attach the post 43 to the tail piece 5.

Thus, the provision of the reinforcing bar 35, the stabilizing bar 39 and the adjustable compensating screw 41 in accordance with the present invention affords means for adjusting the tension in the violin strings and maintaining relatively constant the height between the finger board and the top surface of the violin. These combine to insure playing the plastic violin with the same tone consistency as a wooden violin violin irrespective of any significant change in ambient pressures and temperatures.

Apart from the reinforcing bar 35 and the stabilizing bar 39, the violin is made entirely of plastic. Therefore, it can be fabricated by molding and hence the production of such plastic violin lends itself to ready mass production. Consequently, plastic violins can be made less expensively than their counterpart wooden violins while retaining the tone and sound qualities of the well known wooden violin.

A variety of plastics may be used to fabricate the violin body and the finger board of the plastic violins. Thermoplastic polymers are generally preferred as the materials of construction for such violins. For example, as it is currently contemplated, heat resistant polystyrene is recommended to form the sound board, i.e., the top of the violin, while high impact polystyrene is recommended for the rear panel and edge walls of the violin. In general, however, other thermoplastic polymers can be used to form the sound board and/or the base of such violins.

It is understood that changes, and/or modifications may be made in the construction of plastic violins which are suggested by or obvious from the foregoing detailed description. Such changes and/or modifications are nevertheless within the scope of the present invention. Also, while the present invention has been described with specific reference to violins, it has broader applicability to other stringed musical instruments such as guitars ukeleles, and the like.

What is claimed is:

1. In a plastic violin having a hollow body with an upper bulged portion and a lower bulged portion and edge walls connecting said upper and lower bulged portions, a neck, a finger board, strings, strings attachment means and a bridge, the improvement which comprises:

(a) An elongated reinforcing wooden bar securely attached to said finger board substantially coextensively, said elongated wooden bar having a relatively flat lower section extending from the proximal end of said violin toward the distal end thereof, a relatively upright section extending from the distal end of said flat section and an inclined section extending from said upright section substantially coterminous with said finger board;

(b) An elongated wooden stabilizing bar having two ends, a proximal end normally pressed against said upright section of said reinforcing bar, and a distal end secured at the middle of the end of sad lower bulged portion of the violin body; and (c) A compensating means operably engaged with said stabilizing bar and being manipulable so as to increase or decrease the pressure exerted by the proximal end of said stabilizing bar against said upright section of said reinforcing bar in response to changes in the height between the surface of said finger board and the top surface of the violin.

2. A plastic violin as in claim 1 wherein said compensating means is a threaded screw member.

3. A plastic violin as in claim 1 wherein said elongated wooden reinforcing bar is bonded to said finger board by an adhesive or cement.

4. A plastic violin as in claim 2 wherein said elongated wooden reinforcing bar is bonded to said reinforcing bar by an adhesive or cement.

5. A plastic violin as in claim 1 wherein said violin body and said finger board are made of a thermoplastic polymeric material.

6. A plastic violin as in claim 5 wherein said thermoplastic polymeric material is polystyrene.

* * * * *